United States Patent [19]

Ponti et al.

[11] 4,366,585

[45] Jan. 4, 1983

[54] ARMCHAIR EFFECTIVE TO BE TRANSFORMED INTO A BED

[75] Inventors: Marcello Ponti, Milan; Paolo Cesana, Seregno, both of Italy

[73] Assignee: I.V.M. S.p.A., Milan, Italy

[21] Appl. No.: 193,626

[22] Filed: Oct. 3, 1980

[30] Foreign Application Priority Data

Jun. 30, 1980 [IT] Italy ..... 22179/80[U]

[51] Int. Cl.[3] ..... A47C 17/13

[52] U.S. Cl. ..... 5/18 R; 5/37 R; 5/52; 5/58

[58] Field of Search ..... 5/18 R, 17, 58, 52, 5/37 R, 55 R; 297/248

[56] References Cited

U.S. PATENT DOCUMENTS

| | | | |
|---|---|---|---|
| 146,518 | 1/1874 | Emery | 5/17 |
| 262,181 | 8/1882 | Hale | 5/18 R |
| 403,850 | 5/1889 | Merrill | 5/55 R |
| 607,905 | 11/1897 | Wyngaard | 5/58 |
| 1,045,599 | 11/1912 | Ostendorf | 5/37 R |
| 1,302,397 | 4/1919 | McEwan | 5/58 |
| 2,087,574 | 7/1937 | Koufer | 297/248 |
| 2,307,908 | 1/1943 | Campbell | 5/18 R |
| 2,329,914 | 9/1943 | Kost | 5/18 R |
| 2,931,052 | 4/1960 | Todorovic | 5/52 |
| 3,011,277 | 12/1961 | Vogel | 297/248 |
| 3,201,805 | 8/1965 | Smith | 5/55 R |
| 3,385,631 | 5/1968 | Gertler | 5/18 R |
| 3,973,800 | 8/1976 | Kogan | 297/248 |
| 4,204,287 | 5/1980 | Lane et al. | 5/18 R |
| 4,297,752 | 11/1981 | Dick et al. | 5/52 |

*Primary Examiner*—Roy D. Frazier
*Assistant Examiner*—Michael F. Trettel
*Attorney, Agent, or Firm*—Bucknam and Archer

[57] ABSTRACT

The present invention relates to an armchair effective to be transformed into a bed, comprising a plurality of opened box structures, coupled telescopically to one another and unthreadable from one another in such a way as to provide a resting plane having a length like that of a conventional bed. The level difference occurring in the box structures forming said resting plane or surface is compensated for by using cushions having suitably differentiated heights. To the fixed base structure, furthermore, are coupled a backrest effective to assume two stable positions of different slant, and at least a vertical wall provided with a basculable or tiltable arm and including an unthreadable table arranged to be rested on said tilted arm.

2 Claims, 9 Drawing Figures

Fig. 3
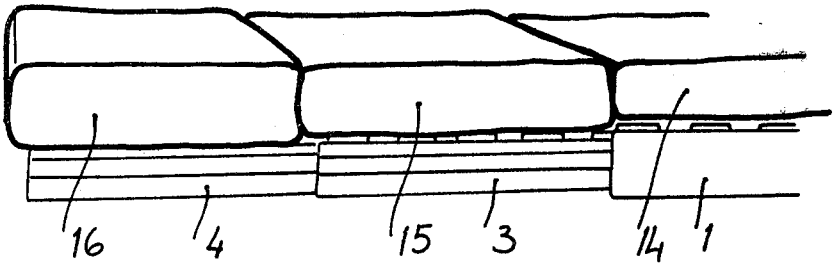
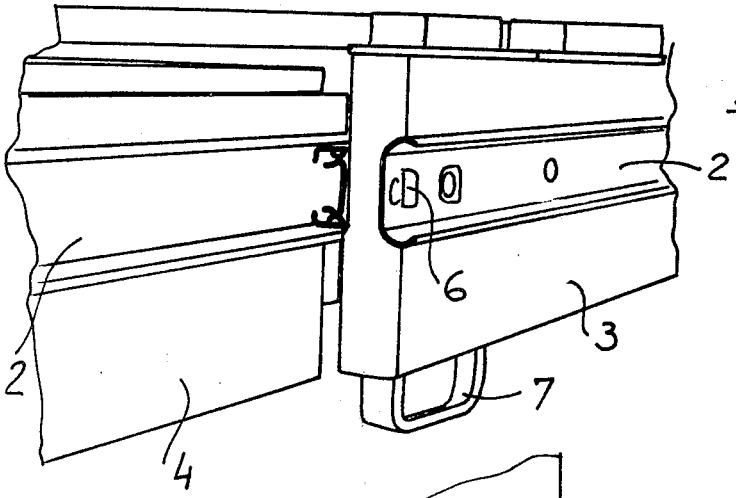
Fig. 4
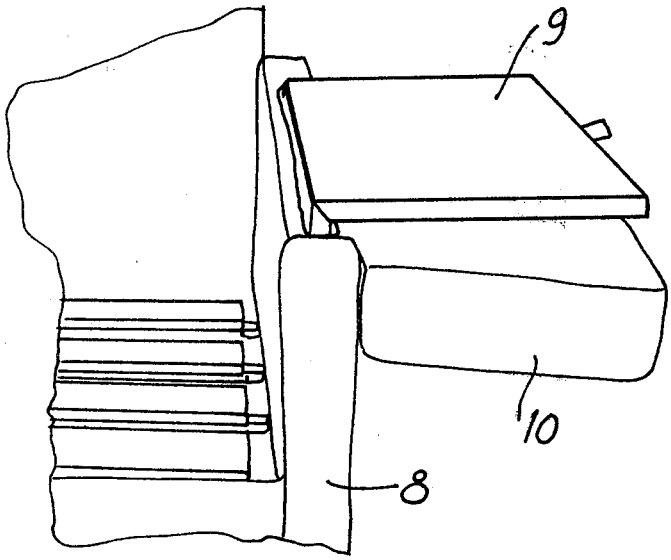
Fig. 5

Fig. 6
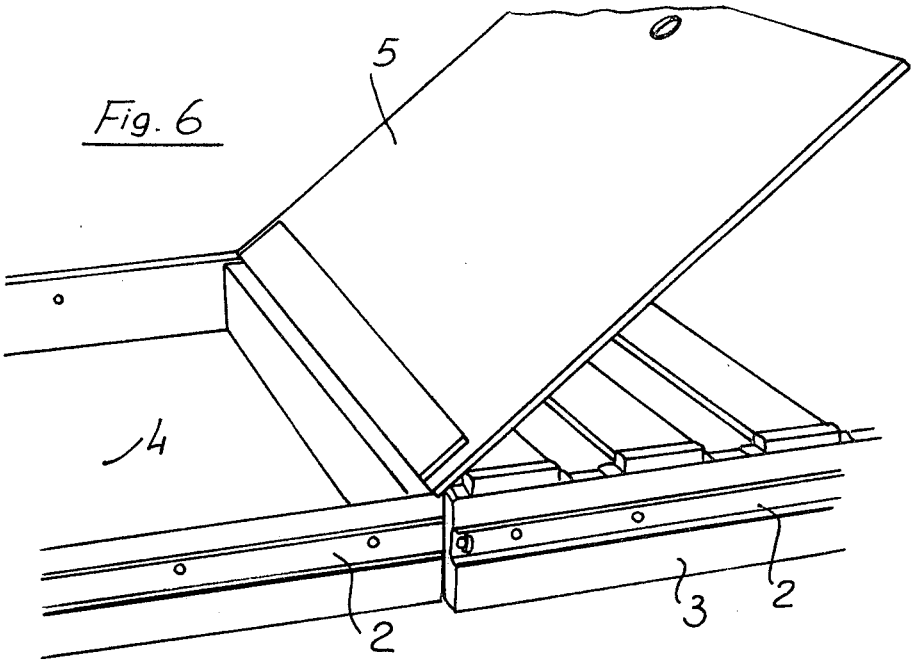
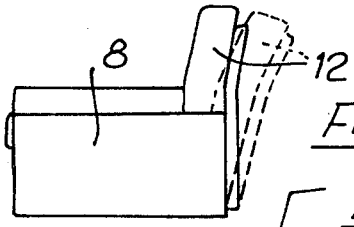
Fig. 7
Fig. 8
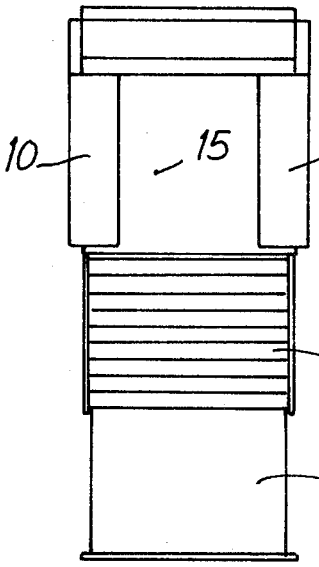
Fig. 9
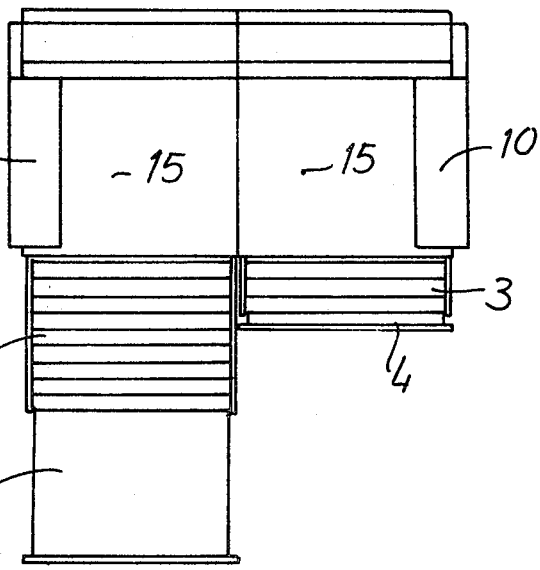

ARMCHAIR EFFECTIVE TO BE TRANSFORMED INTO A BED

The present invention relates to an armchair effective to be transformed into a bed.

More specifically, the present invention relates to an armchair effective to be transformed into a bed having telescopically coupled elements.

As it is known armchairs exist effective to act, in a necessity case, also as a bed. The practical transformation of said armchairs into support structure for a matress, or the like, presents some difficulties of operation which, generally, are tedious for the user.

Accordingly the main object of the present invention is to provide a transformable or convertible armchair which can be transformed easily into a bed or, generally into a supporting structure or frame effective to support a matress or the like.

Another object of the present invention is to provide an armchair effective to be transformed into a bed which can be used in a very simple way.

These and other objects are achieved, according to the present invention, by an armchair effective to be transformed into a bed, comprising a plurality of opened box structures, telescopically coupled to one another and effective to be mutually withdrawn in such a way as to provide a resting plane having a length corresponding to that of a conventional bed.

The level difference occurring in the box like structures forming the aforesaid resting plane or surface is compensated for by using cushions having suitably differentiated heights, and constituting an integrating part of the armchair according to the present invention.

With said fixed box base structure, furthermore, at least a vertical equipped wall is rigid, bearing an arm effective to be or tilted outwardly. This vertical wall includes a restrained table or panel, having the lower edge thereof in the inside of the wall and effective to be withdrawn in such a way as to be rested against the tilted arm.

The aforesaid table, therefore, is able of acting as a resting or bearing surface effective to be used both during the day and during the night.

More specifically, the possible presence of a single wall provided with arm permits to adjoining two armchairs in order to obtain a small di-van effective to be transformed into a double bed.

To the fixed box like base structure there is furthermore articulated a backrest arranged in such a way as to assume two stable positions, of different slant. Owing to this approach, the user can enjoy of two differentiated rest positions, which can be used depending on the needs.

The characteristics of functional and constructional nature of the transformable or convertible armchair according to the present invention will become more apparent from the following description, related to a preferred embodiment of the present invention, given by way of an indicative example, and from the accompanying drawings, where:

FIG. 3 is a partial side view illustrating the resting plane or surface in the bed form, being provided with different height cushions;

FIG. 4 illustrates in a schematic form the sliding coupling of the several box like structures;

FIG. 5 is a perspective schematic view illustrating the arm and the table or panel effective to be superimposed thereon;

FIG. 6 illustrates the box like structure forming the end portion of the resting surface or plane, having a drawer like shape;

FIG. 7 illustrates the positions the backrest may assume;

FIG. 8 is a plan view illustrating the resting surface or plane;

FIG. 9 illustrates two armchairs, with single arm, located one adjoining the other.

Figure 1:
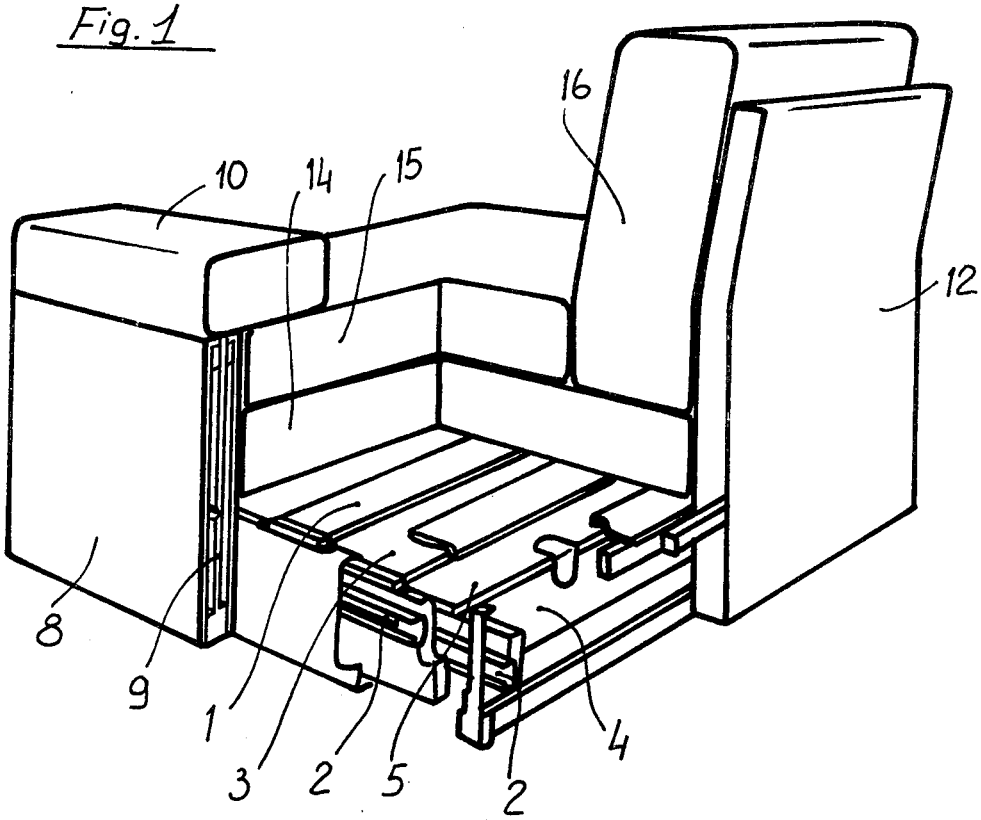
FIG. 1 is a broken away view illustrating the armchair according to the present invention.
Figure 2:
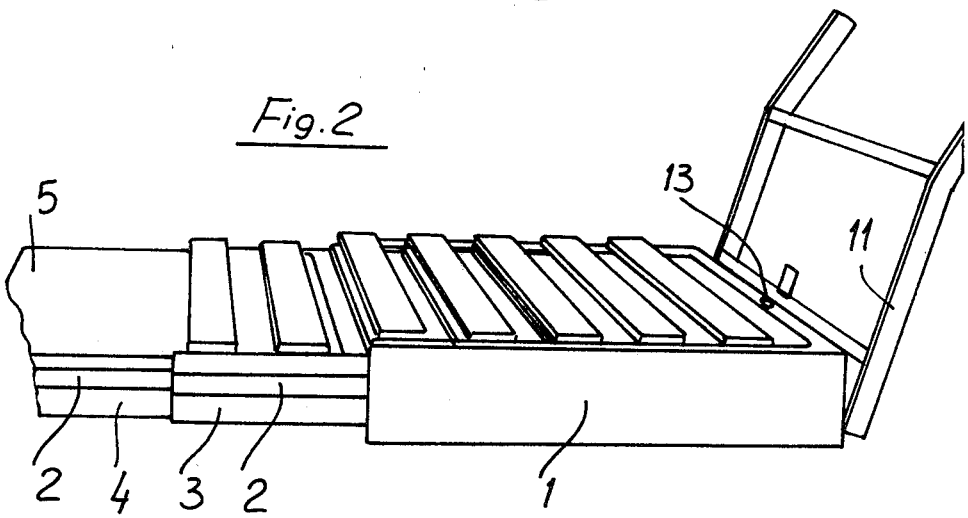
FIG. 2 illustrates the frame of the armchair of FIG. 1, the box like structures being partly withdrawn.

Referring particularly to the figures, the transformable or convertible armchair according to the present invention comprises an outside base structure, opened and of substantially box like shape, indicated by the reference number (1), thereto are telescopically coupled, by means of side sliding guides (2) and suitable wheels, a box like intermediate structure (3), like the base structure (1), and an inside box like structure (4), having preferably a drawer shape and provided with a tiltable cover (5).

The sliding box structures (3) and (4) are provided with stop members, of the limit of stroke type, (6), and with resting feet (7).

With at least a lateral side of the base box structure (1) a vertical wall (8) is rigid, hollow in the inside thereof. In the cavity of said wall (8) an a tiltable table or panel (9) is located, restrained, at the lower edge thereof, in the inside of said wall (8).

The wall (8), furthermore, is provided with an arm (10), also tiltable, and thereon the table (9) can rest (FIG. 5).

At the side corresponding to the back resting side, the base box structure is provided with a frame (11) for the backrest (12), being suitably covered like the wall (8) and the arm (10).

On the lower front portion of said frame (11), in perpendicular, there is fixed a pin effective to penetrate a housing (13), formed in the end upper traverse of the base structure (1).

Said pin acts, substantially, as a snap stop member, effective to cause the backrest to assume a less slant position (FIG. 7).

On the base structure (1) two superimposed cushions (14),(15) are located, of which the top one (15) has a less size than the lower one (14) in such a way as to define a gap between said top cushion (15) and the backrest (12). In said gap a third cushion (16) is located in a vertical position, in such a way as to bear on the backrest.

The cushions (14),(15) and (16) are of differentiated height in order to compensate for the level differences of the resting surface formed by the structures (1),(3), and (4) as these latter are unthreaded one from the other. (FIG. 3).

FIG. 8 illustrates an armchair effective to be transformed into a bed, in which both the resting sides are provided with a hollow wall (8) and arm (10).

FIG. 9 illustrates the coupling of two armchairs effective to be transformed into a double bed, according to the present invention.

Accordingly to this embodiment, each armchair is provided, on a single side, with the hollow wall (8) and arm (10).

From the above description and the observation of the figures of the accompanying drawings, the functionality and facility of use characterizing the armchair effective to be transformed into a bed according to the present invention are self-evident.

Changes, modifications and variations can be brought about to the armchair according to the invention, as illustrated exemplary but not limitatively in the figures of the accompanying drawings, within the spirit of the invention and without departing from the scope thereof.

We claim:

1. An armchair that can be transferred into a bed, which comprises at least one bed unit having a plurality of telescopically interconnected sections moveable from a telescoped condition corresponding to the armchair configuration to an extended condition corresponding to the bed configuration; one of said interconnected sections having a bottom cover and a top cover, said top cover being openable to adapt said section for storage of articles; an adjustable member constituting a back piece of the armchair configuration; and a pair of side armpieces, at least one armpiece including a section pivotable into a laterally extending position and a table section movable from a position recessed into the armpiece to a position overlying said pivotable section.

2. An armchair according to claim 1 including a pair of said bed units disposed in side-by-side relation.

* * * * *